US008353732B2

(12) United States Patent
Ito

(10) Patent No.: US 8,353,732 B2
(45) Date of Patent: Jan. 15, 2013

(54) DUAL HOUSING CONNECTOR WITH LOCKING MEMBERS

(75) Inventor: Yoshitaka Ito, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 13/144,952

(22) PCT Filed: Jan. 20, 2010

(86) PCT No.: PCT/JP2010/050652

§ 371 (c)(1),
(2), (4) Date: Jul. 18, 2011

(87) PCT Pub. No.: WO2010/084891

PCT Pub. Date: Jul. 29, 2010

(65) Prior Publication Data

US 2012/0021633 A1 Jan. 26, 2012

(30) Foreign Application Priority Data

Jan. 20, 2009 (JP) ..... 2009-010123

(51) Int. Cl.
*H01R 13/514* (2006.01)

(52) U.S. Cl. ..... 439/752

(58) Field of Classification Search ..... 439/752, 439/595, 686

See application file for complete search history.

(56) References Cited

U.S. PATENT DOCUMENTS

| | | | | |
|---|---|---|---|---|
| 5,299,958 | A * | 4/1994 | Ohsumi | 439/752 |
| 7,281,961 | B1 | 10/2007 | Sugiyama et al. | |
| 2002/0072277 | A1 | 6/2002 | Tanaka | |

FOREIGN PATENT DOCUMENTS

| | | | |
|---|---|---|---|
| JP | 10-162888 | A | 6/1998 |
| JP | 10-509549 | A | 9/1998 |
| JP | 2002-25676 | A | 1/2002 |
| JP | 2007-305454 | A | 11/2007 |
| WO | 96/10850 | A1 | 4/1996 |

OTHER PUBLICATIONS

International Search Report (PCT/ISA/210) dated Mar. 2, 2010, in Application No. PCT/JP2010/050652.

* cited by examiner

*Primary Examiner* — Edwin A. Leon
*Assistant Examiner* — Harshad Patel
(74) *Attorney, Agent, or Firm* — Sughrue Mion, PLLC

(57) ABSTRACT

A connector in which terminal extraction work using an extraction jig can surely be done when necessary and also at the normal time, a terminal of the other connector can be connected to a terminal of the inside of a terminal receiving chamber without any mistakes and fear of a poor fit can be removed is provided. In the connector having two connector housings 20, 10 attached with the connector housings stacked mutually, a connector front wall 17 with which the front ends of terminal receiving chambers 21 of the first connector housing 20 are covered is formed integrally to the second connector housing 10, and a terminal insertion opening 18 opened in the connector front wall 17 is provided so as to deviate from the front of a first terminal 70 and be positioned in the front of a first lance 22 for locking the first terminal when both the connector housings are held in a temporary locking position.

3 Claims, 13 Drawing Sheets

DUAL HOUSING CONNECTOR WITH LOCKING MEMBERS

TECHNICAL FIELD

The present invention is related to a connector constructed so as to facilitate terminal extraction work necessary due to a mistake etc. in inserting a terminal.

BACKGROUND ART

FIG. 14 is a sectional view of a conventional connector described in, for example, Patent Literature 1, and FIG. 15 is a front view of the same connector.

As shown in FIGS. 14 and 15, a connector generally includes a connector housing 101 having terminal receiving chambers 102, and terminals (female terminals in an illustrated example) 110 inserted into the terminal receiving chambers 102. The inside of each of the terminal receiving chambers 102 is provided with a flexible lance 105. When the terminal 110 is inserted into the terminal receiving chamber 102 from the back, the terminal 110 reaches a predetermined position while pushing up the lance 105. In a stage in which the terminal reaches the predetermined position, the lance 105 is restored to the original position and thereby, the lance 105 prevents the terminal 110 from coming out backward.

The front end of the terminal receiving chamber 102 is generally covered with a front wall 117. The terminal 110 received inside the terminal receiving chamber 102 can be connected to the other connector terminal by inserting the other connector terminal from a terminal insertion opening 118 opened in the front wall 117.

Incidentally, in the case of making a mistake etc. in inserting a terminal, the need to extract the terminal 110 arises. In that case, an extraction jig 120 is inserted from a jig insertion hole 119 formed in the front wall 117 of the connector housing 101. The extraction jig 120 generally extracts the terminal 110 backward in a state of deforming the lance 105 to a position capable of disengaging from the terminal 110 forcibly.

CITATION LIST

Patent Literature

Patent Literature 1: JP-A-2002-25676

SUMMARY OF INVENTION

Technical Problem

However, when the jig insertion hole 119 for inserting the extraction jig 120 is near to the terminal insertion opening 118, a male terminal of the other connector may be inserted into the jig insertion hole 119 by mistake. As a result, a poor fit may be caused.

In consideration of the circumstances described above, an object of the invention is to provide a connector having at least the following two features. One of the features is that terminal extraction work using an extraction jig is surely done when necessary. Another feature is that at the normal time, a terminal of the other connector can be connected to a terminal of the inside of a terminal receiving chamber without any mistakes and fear of a poor fit is removed.

Solution to Problem

A first aspect of the invention is a connector comprising:

a first connector housing, including plural terminal receiving chambers which are respectively provided with first lances and receive terminals fixed by the first lances, and a locking member; and a second connector housing, including a first locking member, a second locking member, and a wall part including plural openings respectively corresponding to the terminal receiving chambers, wherein each of the openings is positioned in a front of a lance which is provided in the corresponding terminal receiving chamber, while the locking member engages with the first locking member and the first connector housing and the second connector housing are in a temporary locking position, and wherein each of the openings is positioned in a front of the terminal received in the corresponding terminal receiving chamber, while the locking member engages with the second locking member and the first connector housing and the second connector housing are in a permanent locking position.

A second aspect of the invention is a connector wherein the second connector housing includes a first double locking part, the first locking part further doubly locks the first terminal retained by the first lance, when the first connector housing and the second connector housing are held in the permanent locking position, and the first locking part releases double locking to the first terminal, when the first connector housing and the second connector housing are held in the temporary locking position.

Also, a third aspect of the invention is a connector comprising: a second flexible lance provided in a terminal receiving chamber of the second connector housing for retaining and fixing a second terminal inserted from a back end of the terminal receiving chamber; and a second double locking part provided in the first connector housing, wherein the second double locking part further doubly locks the second terminal retained by the second lance, when the first connector housing and the second connector housing are held in the permanent locking position, and the second double locking part releases double locking to the second terminal, when the first connector housing and the second connector housing are held in the temporary locking position.

Advantageous Effects of Invention

According to the first aspect of the invention, a terminal insertion opening opened in a connector front wall can be shifted from the front of the first terminal to the front of the first lance by separating the first connector housing and the second connector housing mutually united in a state of receiving the terminal from the permanent locking position to the temporary locking position. The top of a terminal extraction jig is inserted into the terminal insertion opening and a state of forcibly deforming the first lance by the top of the jig is formed and thereby, the terminal can be extracted backward. Therefore, a dedicated jig insertion hole for inserting the jig can be eliminated from the connector front wall and as a result, a situation in which a male terminal of the other connector is inserted into the jig insertion hole by mistake and a poor fit of the connector is caused is eliminated.

According to the second aspect of the invention, the first terminal of the inside of the first connector housing can more surely be prevented from coming out since the first double locking part doubly locks the first terminal together with the first lance when the first and second connector housings are changed from the temporary locking position to the permanent locking position.

According to the third aspect of the invention, the second terminal of the inside of the second connector housing can more surely be prevented from coming out since the second double locking part doubly locks the second terminal together with the second lance when the first and second connector housings are changed from the temporary locking position to the permanent locking position.

DESCRIPTION OF EMBODIMENTS

An embodiment of the invention will hereinafter be described with reference to the drawings.

Figure 13A:
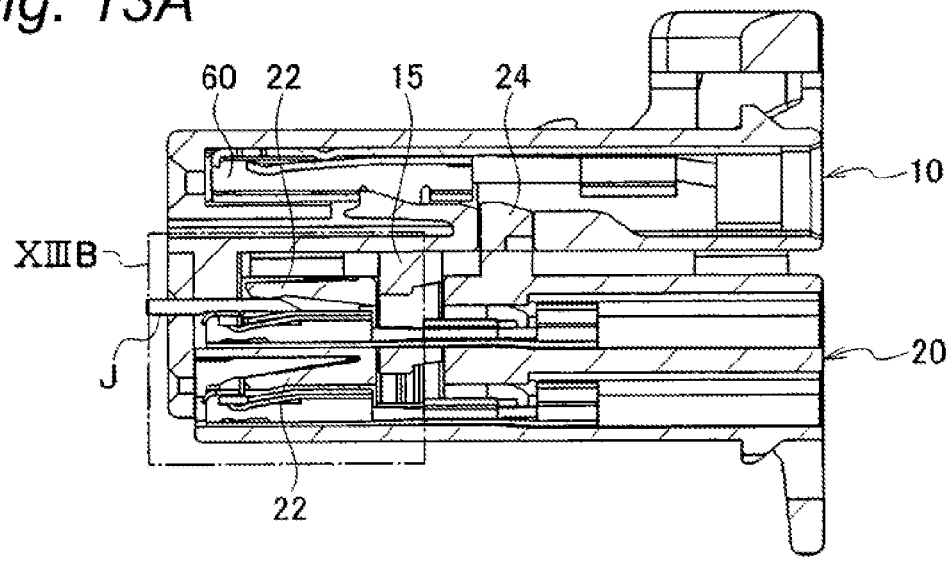
FIG. 13A is a diagram showing a state of deforming a lance by the top of the extraction jig and is a diagram showing a state of further inserting the extraction jig from a state of FIG. 12A.
Figure 13B:
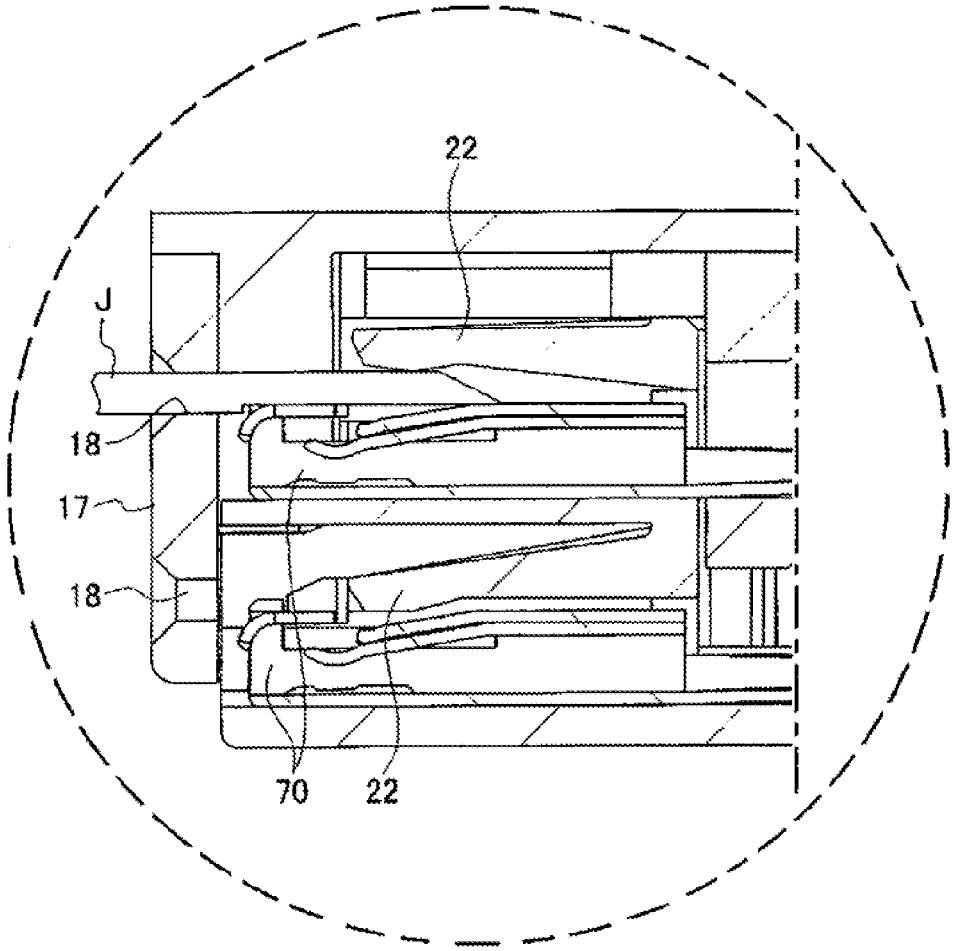
FIG. 13B is an enlarged view of a portion XIIIB of FIG. 13A.
Figure 14:
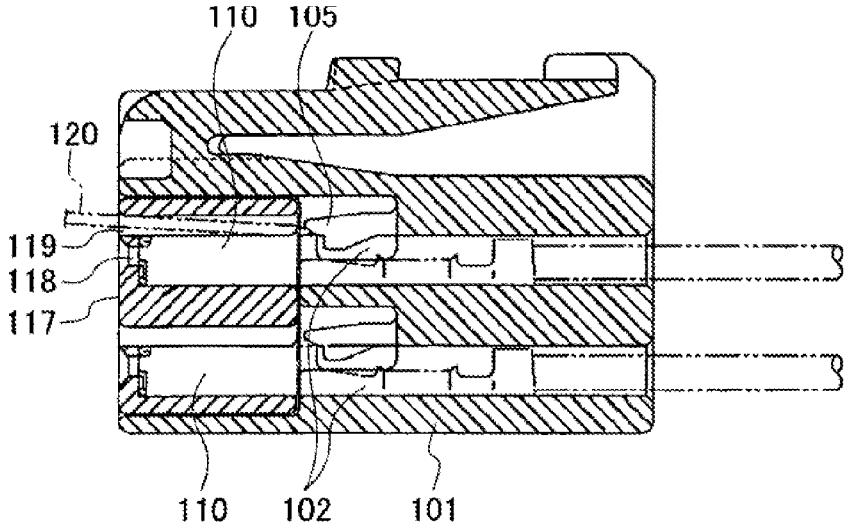
FIG. 14 is a sectional side view of a connector of a conventional example.
Figure 15:
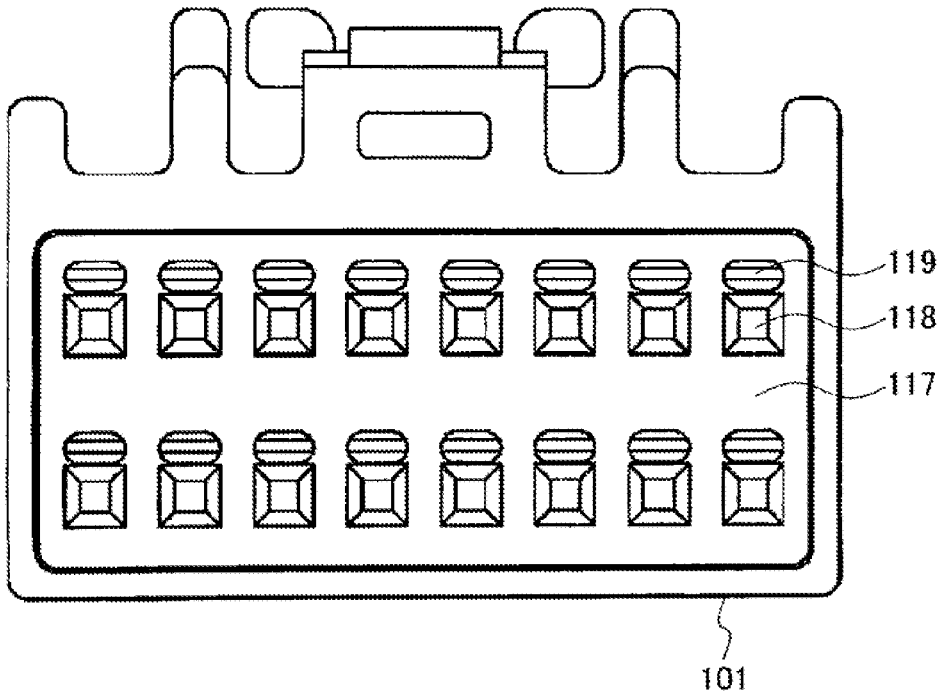
FIG. 15 is a front view of the connector of the conventional example.

FIGS. 1 to 4B are configuration diagrams showing a state in which a first connector housing and a second connector housing constructing a connector of the embodiment are in a temporary locking position. FIGS. 5 to 8B are configuration diagrams showing a state in which the first connector housing and the second connector housing are in a permanent locking position. FIGS. 9 to 12B are configuration diagrams showing a state of inserting an extraction jig into a terminal insertion opening provided in a connector front wall in the state in which the first connector housing and the second connector housing are in the temporary locking position. FIGS. 13A and 13B are diagrams showing a state of deforming a lance by the top of the extraction jig.

As shown in FIGS. 1 to 13B, the connector of the embodiment includes a first connector housing 20, a second connector housing 10 attached with the second connector housing stacked on the upper side of the first connector housing 20, a first terminal 70 received inside the first connector housing 20, and a second terminal 60 received inside the second connector housing 10. The first terminal 70 is a female terminal and is constructed so that a male terminal (not shown) of the other connector can be received from a front end inlet 71 (see FIGS. 4A and 4B).

The first connector housing 20 and the second connector housing 10 are respectively provided with plural terminal receiving chambers 21, 11 along front and back directions (a connector fitting direction is herein called the front and back directions). Each of the terminal receiving chambers 21, 11 is provided with first and second flexible lances 22, 12 for retaining and fixing the first and second terminals 70, 60 inserted from the back. The plural terminal receiving chambers 21, 11 of the first connector housing 20 and the second connector housing 10 are arranged in one line sideways. The terminal receiving chambers 21 of the first connector housing 20 are disposed in multiple steps (two steps in an illustrated example) in a direction in which the second connector housing 10 is stacked on the first connector housing 20.

Also, both sides of the front and back of the first connector housing 20 and the second connector housing 10 are provided with lock protrusions 27*a*, 27*b* and lock arms 16 for locking the first connector housing 20 and the second connector housing 10. The top of the lock arm 16 is provided with a lock claw 16*a*. The lock claws 16*a* engage with any of the lock protrusions 27*a*, 27*b* and thereby, the first connector housing 20 and the second connector housing 10 can be selectively held in the permanent locking position (position of FIGS. 5 to 8B) in which the housings are completely attached, and the temporary locking position (position of FIGS. 1 to 4B) in which the housings are halfway attached.

Figure 1:
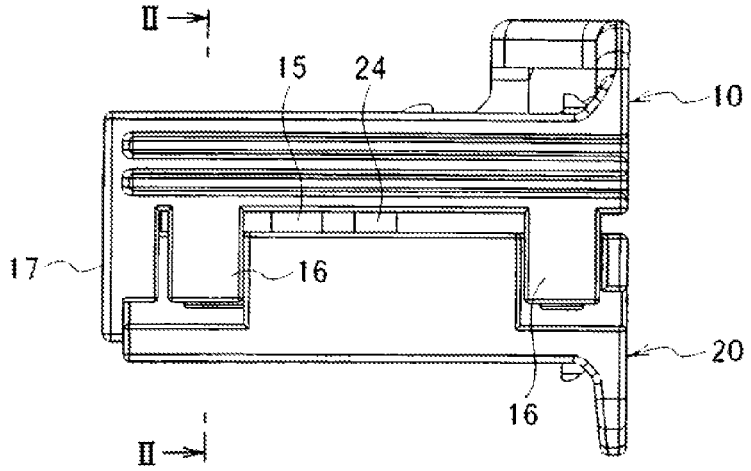
FIG. 1 is a side view showing a state in which a first connector housing and a second connector housing constructing a connector of on embodiment of the invention are in a temporary locking position.
Figure 2:
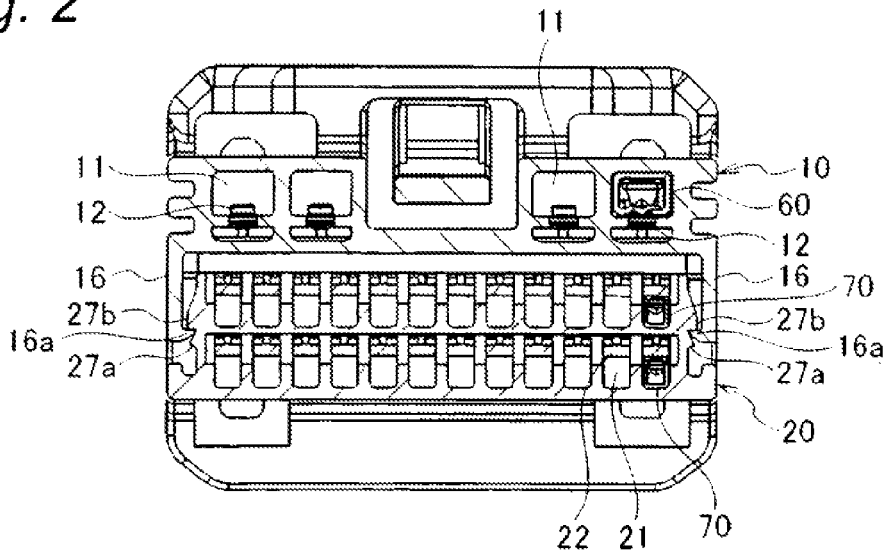
FIG. 2 is a sectional view taken on line II-II of FIG. 1.
Figure 3A:
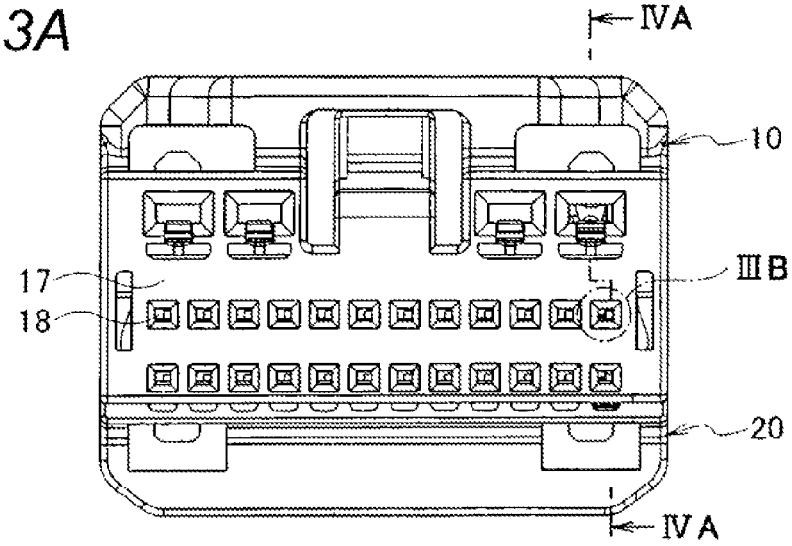
FIG. 3A is a front view of the connector in the state of FIG. 1.
Figure 3B:
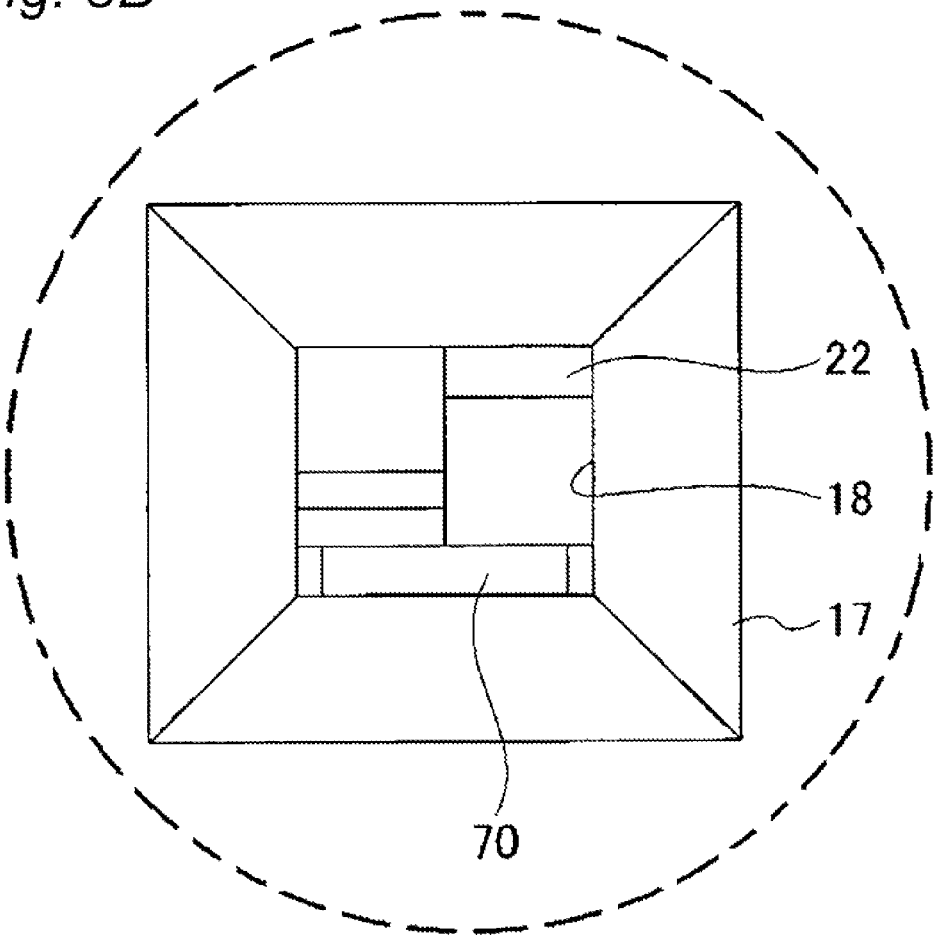
FIG. 3B is an enlarged view of a portion IIIB of FIG. 3A.
Figure 4A:
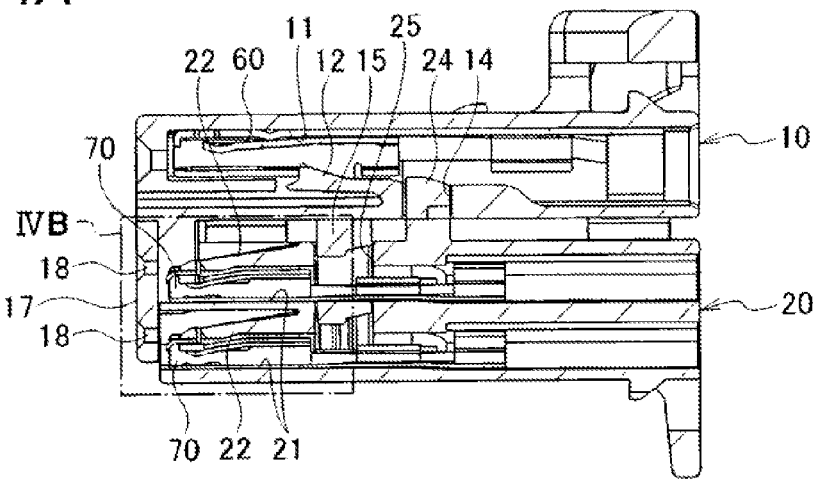
FIG. 4A is a sectional view taken on line IVA-IVA of FIG. 3A.
Figure 4B:
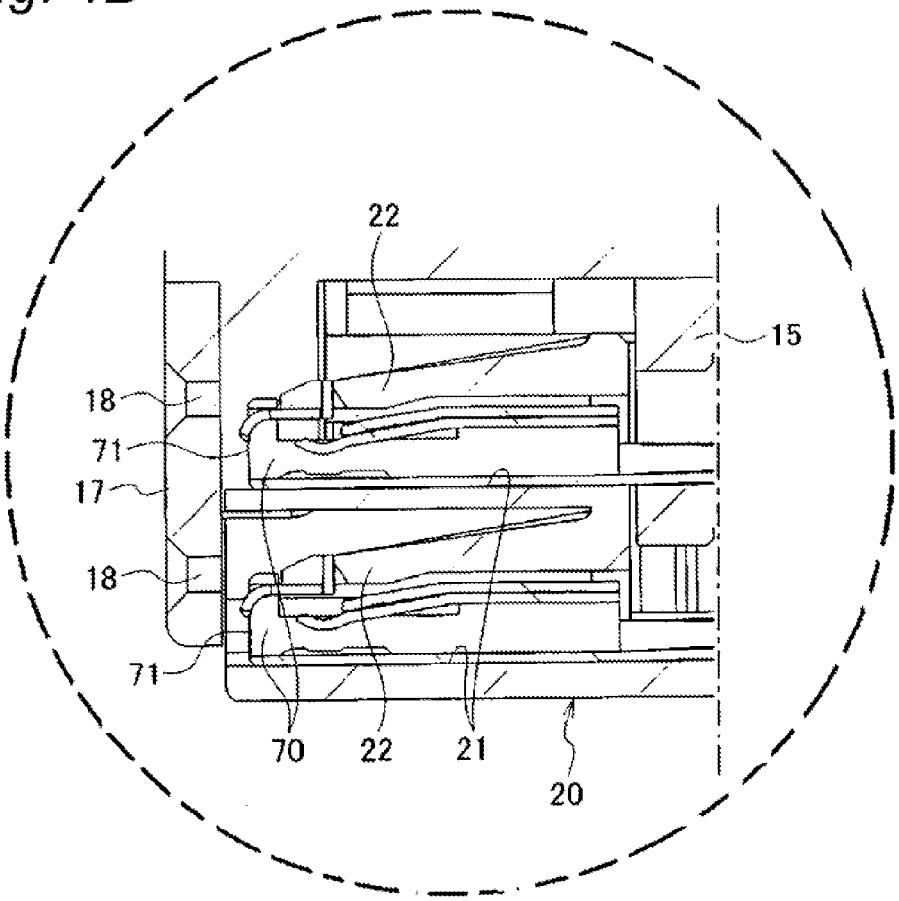
FIG. 4B is an enlarged view of a portion IVB of FIG. 4A.
Figure 5:
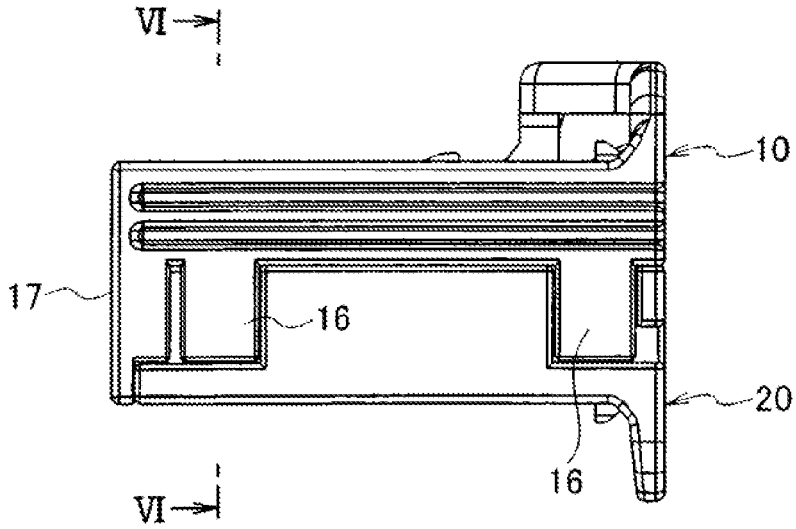
FIG. 5 is a side view showing a state in which the first connector housing and the second connector housing are in a permanent locking position.
Figure 6:
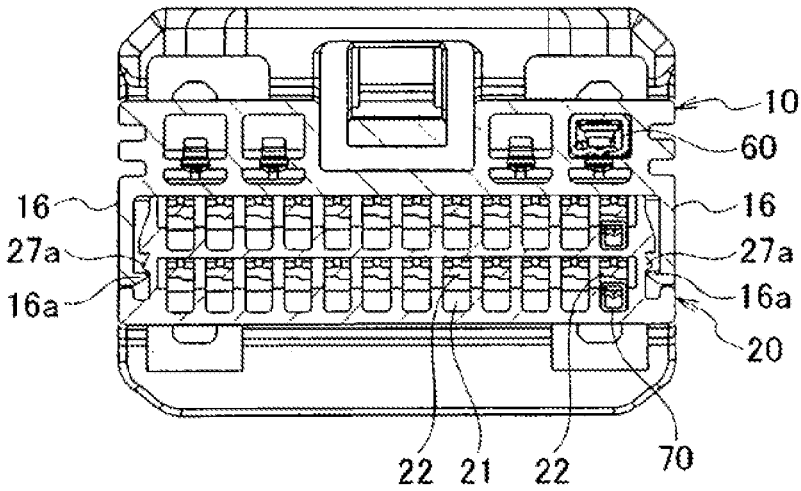
FIG. 6 is a sectional view taken on line VI-VI of FIG. 5.
Figure 7A:
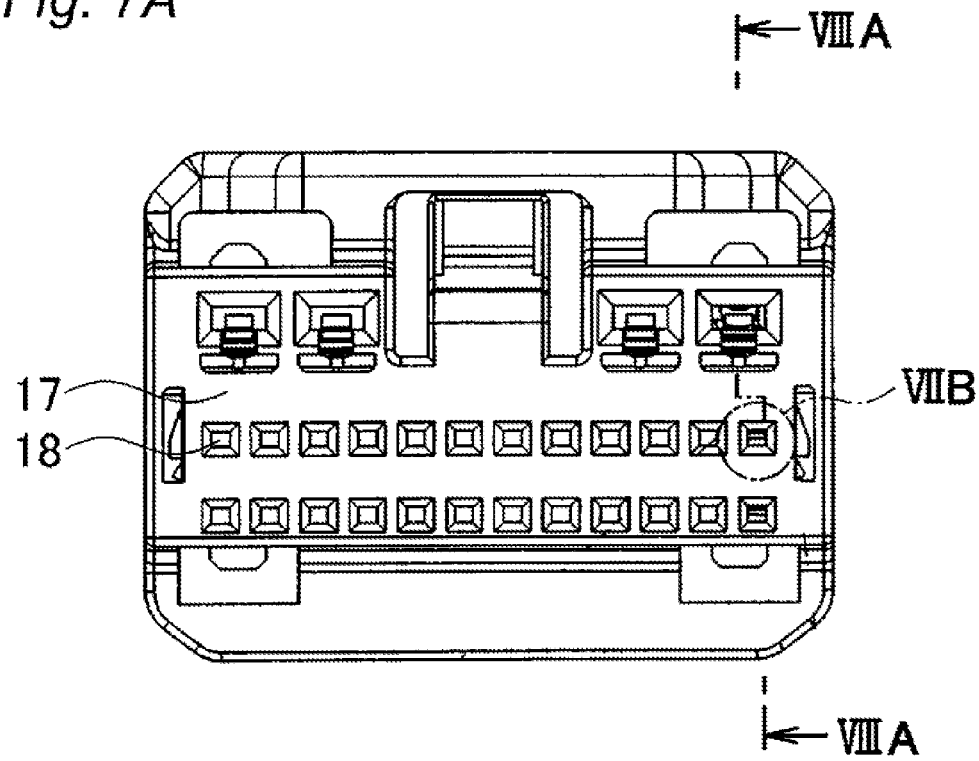
FIG. 7A is a front view of the connector in the state of FIG. 5.
Figure 7B:
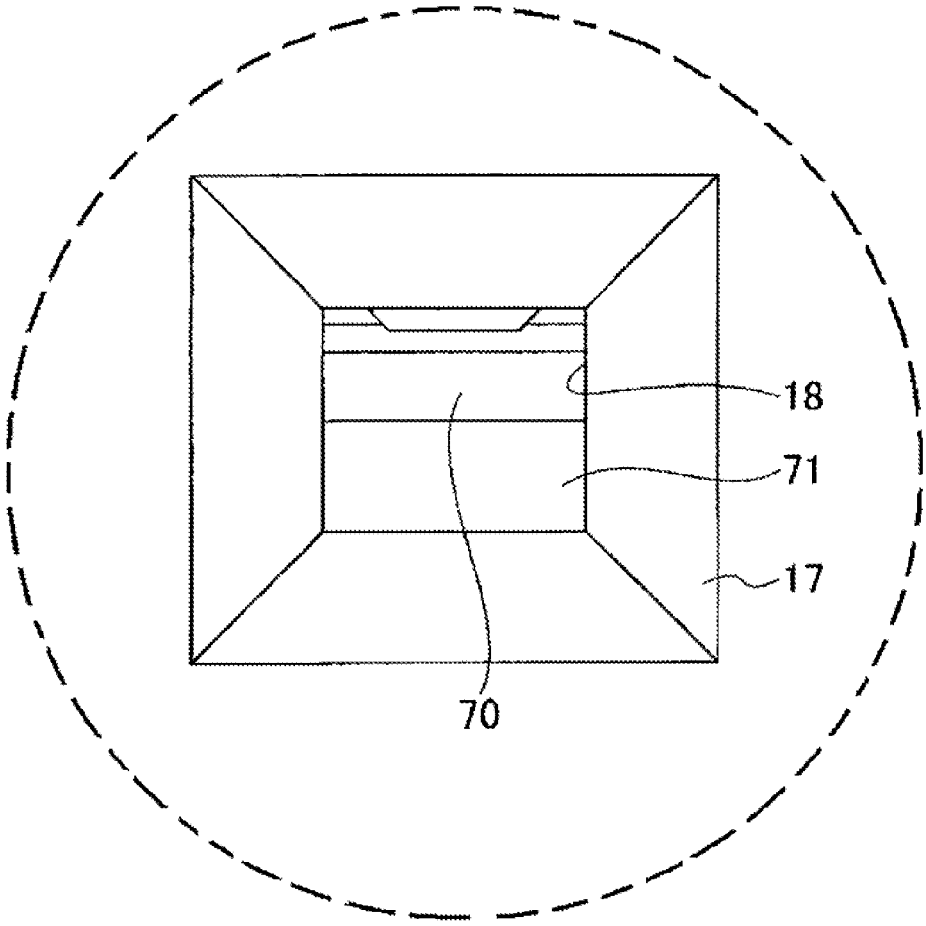
FIG. 7B is an enlarged view of a portion VIIB of FIG. 7A.
Figure 8A:
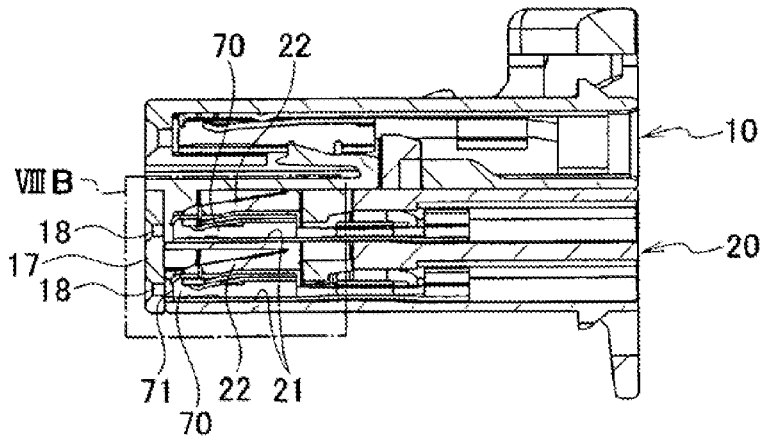
FIG. 8A is a sectional view taken on line VIIIA-VIIIA of FIG. 7A.
Figure 8B:
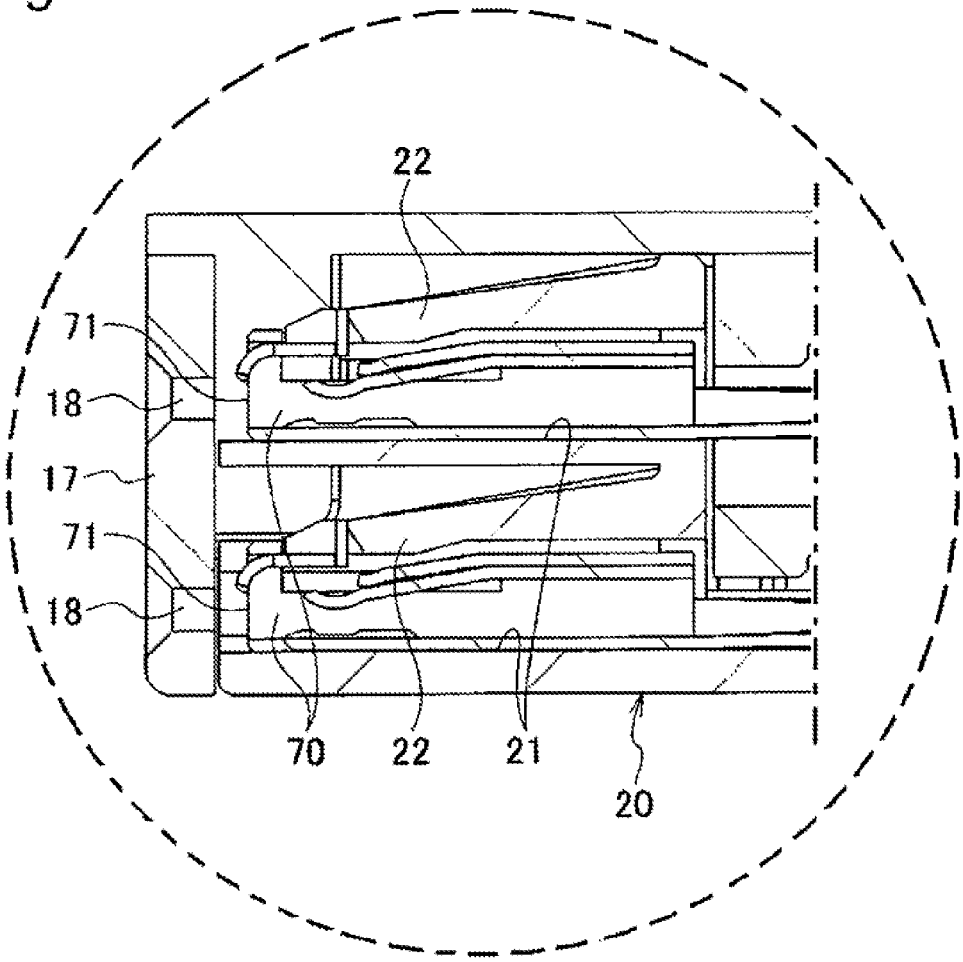
FIG. 8B is an enlarged view of a portion VIIIB of FIG. 8A.
Figure 9:
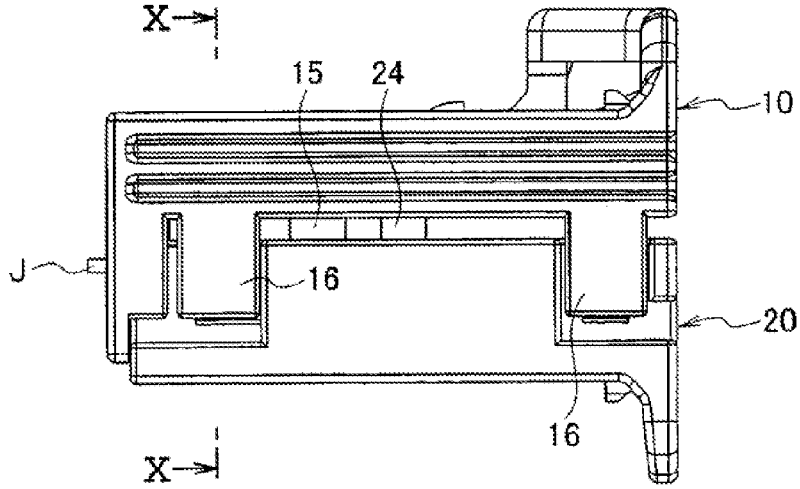
FIG. 9 is a side view showing a state of inserting an extraction jig into a terminal insertion opening provided in a connector front wall in the state in which the first connector housing and the second connector housing are in the temporary locking position.
Figure 10:
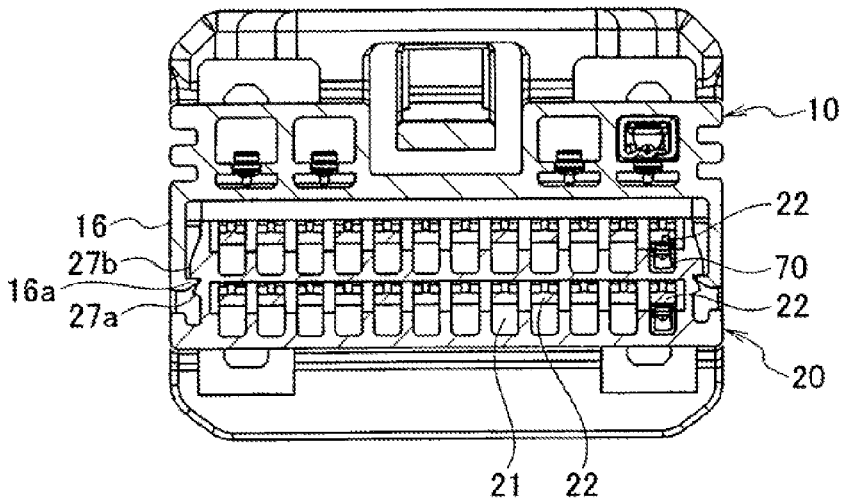
FIG. 10 is a sectional view taken on line X-X of FIG. 9.
Figure 11A:
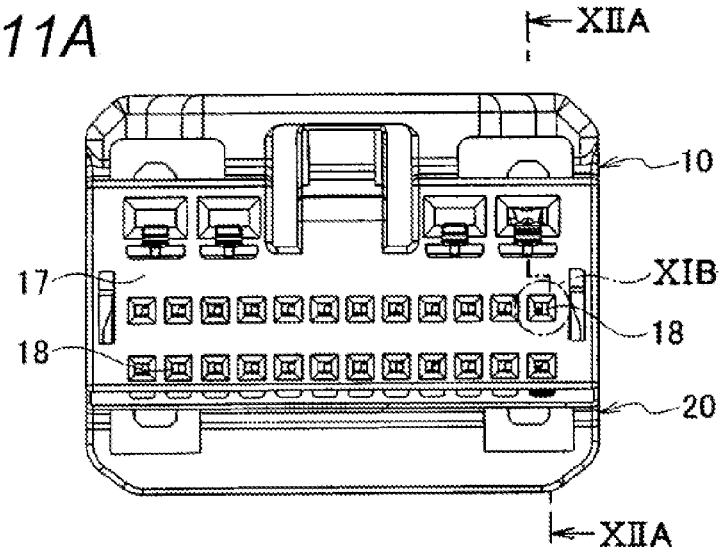
FIG. 11A is a front view of the connector in the state of FIG. 9.
Figure 11B:
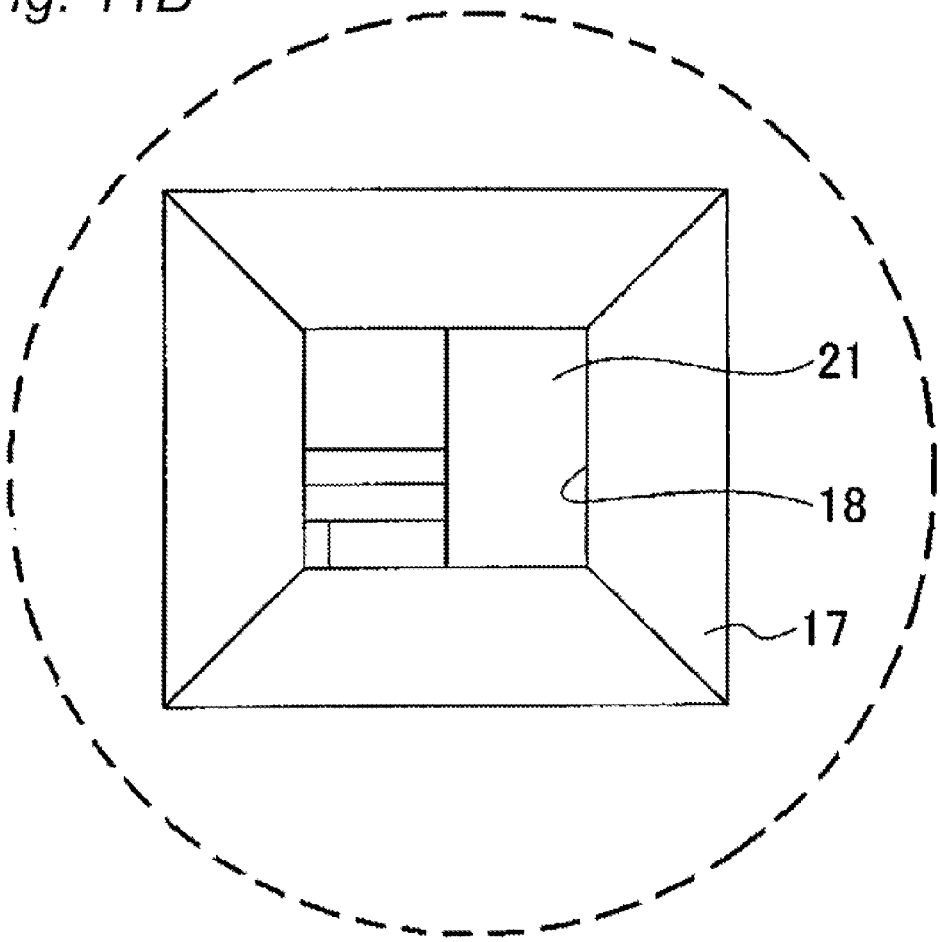
FIG. 11B is an enlarged view of a portion XIB of FIG. 11A.
Figure 12A:
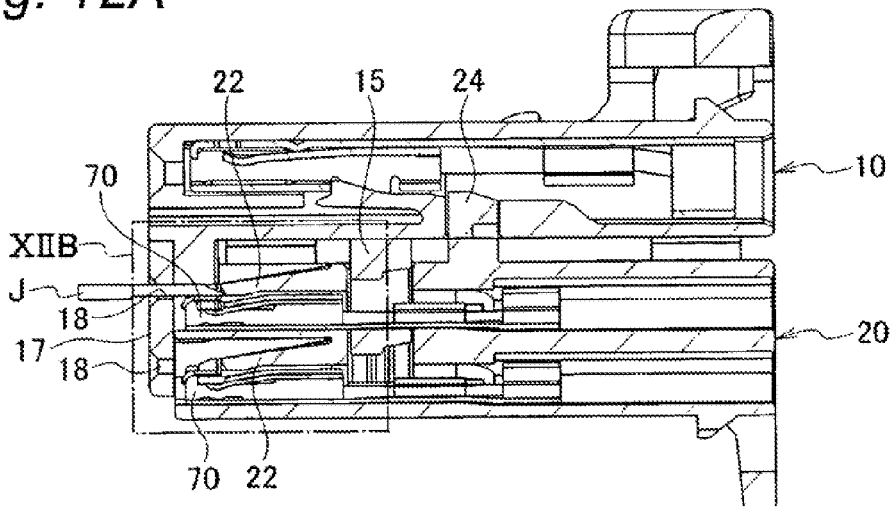
FIG. 12A is a sectional view taken on line XIIA-XIIA of FIG. 11A.
Figure 12B:
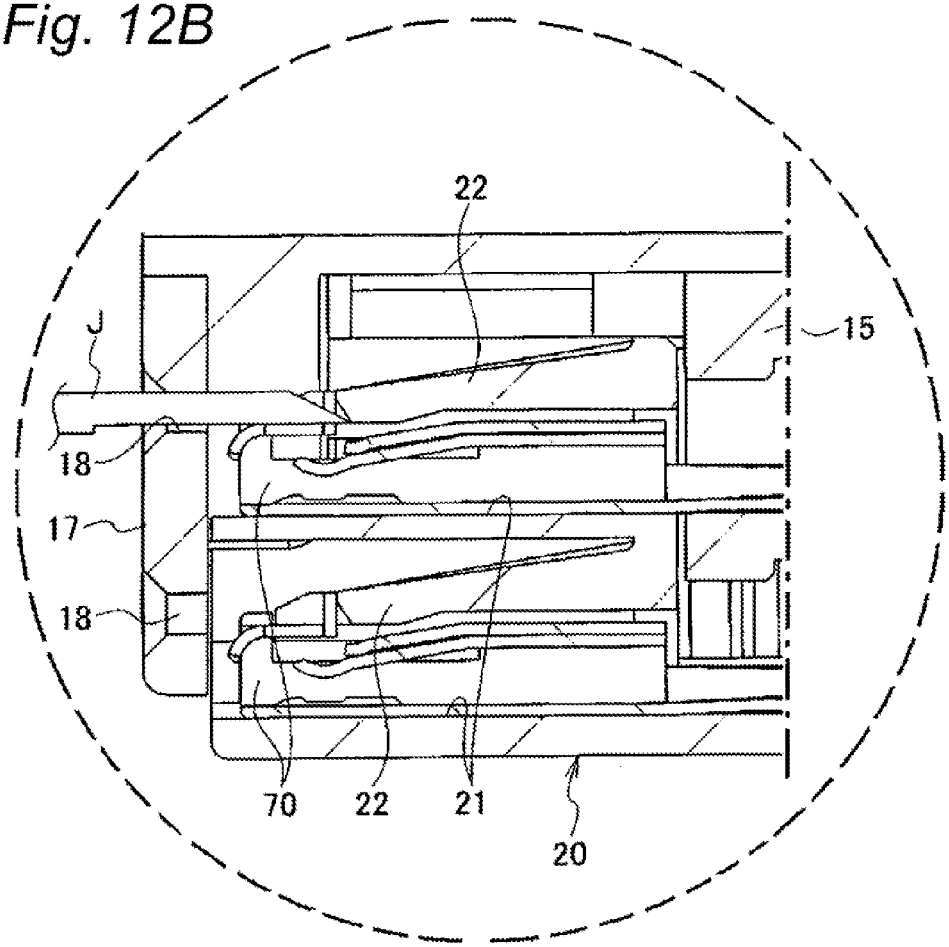
FIG. 12B is an enlarged view of a portion XIIB of FIG. 12A.

As shown in FIG. 6, the first connector housing 20 and the second connector housing 10 can be held in the permanent locking position by engaging the lock claws 16*a* with the first lock protrusions 27*a*. Also, as shown in FIGS. 2 and 10, the first connector housing 20 and the second connector housing 10 can be held in the temporary locking position by engaging the lock claws 16*a* between the first lock protrusions 27*a* and the second lock protrusions 27*b*.

Therefore, a temporary locking member and a permanent locking member are constructed by combinations of the lock claws 16*a* and the lock protrusions 27*a*, 27*b*.

Also, the second connector housing 10 is provided with a first double locking part 15. The first double locking part 15 further doubly locks the first terminal 70 retained by the first lance 22 when the first connector housing 20 and the second connector housing 10 are held in the permanent locking position. Also, the first double locking part 15 releases double locking with respect to the first terminal 70 when the first connector housing 20 and the second connector housing 10 are held in the temporary locking position. This first double locking part 15 is provided so as to protrude to the lower side of the second connector housing 10, and is slidably inserted into slide space 25 formed in the first connector housing 20.

Similarly, the first connector housing 20 is provided with a second double locking part 24. The second double locking part 24 further doubly locks the second terminal 60 retained by the second lance 12 when the first connector housing 20 and the second connector housing 10 are held in the permanent locking position. Also, the second double locking part 24 releases double locking with respect to the second terminal 60 when the first connector housing 20 and the second connector housing 10 are held in the temporary locking position. This second double locking part 24 is provided so as to protrude to the upper side of the first connector housing 20, and is slidably inserted into slide space 14 formed in the second connector housing 10.

Then, the first and second terminals 70, 60 can be respectively inserted into the terminal receiving chambers 21, 11 of each of the connector housings 20, 10 from the back without being blocked by the first and second double locking parts 15, 24 when the first connector housing 20 and the second connector housing 10 are held in the temporary locking position.

Also, in this connector, a connector front wall 17 with which the front ends of the terminal receiving chambers 21 of the first connector housing 20 are covered is provided integrally to the side of the second connector housing 10 rather than the side of the first connector housing 20. A terminal insertion opening 18 for inserting a male terminal of the other connector connected to the first terminal 70 by being positioned in the front of the first terminal 70 received in the terminal receiving chamber 21 of the first connector housing 20 is opened in this connector front wall 17. The terminal insertion opening 18 is provided so as to deviate from the front of the first terminal 70 and be positioned in the front of the first lance 22 when the first connector housing 20 and the second connector housing 10 are held in the temporary locking position.

Next, an assembly procedure will be described.

In the case of assembling this connector, as shown in FIGS. 1 to 4B, the second connector housing 10 is first put on the upper side of the first connector housing 20, and the lock claws 16*a* of the lock arms 16 of the side of the second connector housing 10 are engaged between the first lock protrusions 27*a* and the second lock protrusions 27*b* of the side of the first connector housing 20 and thereby, the first connector housing 20 and the second connector housing 10 are held in the temporary locking position.

Then, in that state, the first terminal 70 is inserted into the terminal receiving chamber 21 of the first connector housing 20 from the back and also the second terminal 60 is inserted into the terminal receiving chamber 11 of the second connector housing 10 from the back. At this time, the first and second double locking parts 15, 24 are in a position in which insertion of the terminals 70, 60 is not blocked.

When the terminals 70, 60 are inserted, the lances 22, 12 are pushed by the terminals 70, 60 and are flexibly deformed and the terminals 70, 60 are permitted to pass. When the terminals 70, 60 are further inserted, the terminals 70, 60 reach the front ends of the terminal receiving chambers 11, 21 and also the lances 22, 12 are restored from a flexure position and the tops of the lances 22, 12 engage with the terminals 70, 60 and thereby, the terminals 70, 60 are prevented from coming out backward (primary locking).

After the terminals 70, 60 are inserted, the lock claws 16*a* of the lock arms 16 of the side of the second connector housing 10 are engaged with the first lock protrusions 27*a* of the side of the first connector housing 20 by pushing the second connector housing 10 against the first connector housing 20 as shown in FIGS. 5 to 8B. As a result, the first connector housing 20 and the second connector housing 10 are locked permanently.

Also in this state, the first double locking part 15 formed in the side of the second connector housing 10 enters a recess etc. of the first terminal 70 and doubly locks the first terminal 70. Also, the second double locking part 24 formed in the side of the first connector housing 20 enters a recess etc. of the second terminal 60 and doubly locks the second terminal 60. Consequently, the connector is completed.

Also, when the need to detach the first terminal 70 arises after the connector housings are locked permanently thus, the second connector housing 10 is returned to the temporary locking position with respect to the first connector housing 20 as shown in FIGS. 9 to 12B. That is, the first connector housing 20 and the second connector housing 10 in the permanent locking position are separated and the lock claws 16*a* of the lock arms 16 are engaged between the first lock protrusions 27*a* and the second lock protrusions 27*b*.

As a result, double locking by the first double locking part 15 is released and also the connector front wall 17 moves relatively to the first connector housing 20 and thereby, the terminal insertion opening 18 provided in the connector front wall 17 shifts from the front of the first terminal 70 to the front of the first lance 22 for engaging the first terminal 70.

Hence, as shown in FIGS. 9 to 12B and FIG. 13B, the top of a terminal extraction jig J is inserted into the terminal insertion opening 18 and a state of forcibly deforming the first lance 22 by the top of the jig J is formed. By forming such a state, the first terminal 70 can be extracted backward.

Therefore, a dedicated jig insertion hole for inserting the jig J can be eliminated from the connector front wall 17. As a result, a situation in which a male terminal of the other connector is inserted into the jig insertion hole by mistake and a poor fit of the connector is caused is eliminated.

Also, the terminals 70, 60 of the inside of each of the connector housings 20, 10 can more surely be prevented from coming out since the first and second double locking parts 15, 24 doubly lock the first terminal 70 and the second terminal 60 together with the lances 22, 12 when the first and second connector housings 20, 10 are changed from the temporary locking position to the permanent locking position.

REFERENCE SIGNS LIST

10 SECOND CONNECTOR HOUSING
11 TERMINAL RECEIVING CHAMBER
12 SECOND LANCE
15 FIRST DOUBLE LOCKING PART
16*a* LOCK CLAW (PERMANENT LOCKING MEMBER, TEMPORARY LOCKING MEMBER, LOCKING MEMBER FOR LANCE RELEASE)
17 Connector Front Wall
18 TERMINAL INSERTION OPENING
20 FIRST CONNECTOR HOUSING
21 TERMINAL RECEIVING CHAMBER
22 FIRST LANCE
24 SECOND DOUBLE LOCKING PART
27*a* FIRST LOCK PROTRUSION (PERMANENT LOCKING MEMBER, TEMPORARY LOCKING MEMBER)
27*b* SECOND LOCK PROTRUSION (TEMPORARY LOCKING MEMBER)
60 SECOND TERMINAL
70 FIRST TERMINAL
J EXTRACTION JIG

The invention claimed is:

1. A connector comprising:

a first connector housing, including plural terminal receiving chambers which are respectively provided with first lances and receive terminals fixed by the first lances, and a first locking member and a second locking member; and a second connector housing, including a locking member, and a wall part including plural openings respectively corresponding to the terminal receiving chambers, wherein each of the openings is positioned in a front of a lance which is provided in the corresponding terminal receiving chamber, while the locking member engages with the first locking member and the first connector housing and the second connector housing are in a temporary locking position, and wherein each of the openings is positioned in a front of the terminal received in the corresponding terminal receiving chamber, while the locking member engages with the second locking member and the first connector housing and the second connector housing are in a permanent locking position.

2. The connector according to claim 1, wherein the second connector housing includes a first double locking part, wherein the first locking part further doubly locks the first terminal retained by the first lance, when the first connector housing and the second connector housing are held in the permanent locking position, and wherein the first locking part releases double locking to the first terminal, when the first connector housing and the second connector housing are held in the temporary locking position.

3. The connector according to claim 1, further comprising:

a second flexible lance provided in a terminal receiving chamber of the second connector housing for retaining and fixing a second terminal inserted from a back end of the terminal receiving chamber; and a second double locking part provided in the first connector housing, wherein the second double locking part further doubly locks the second terminal retained by the second lance, when the first connector housing and the second connector housing are held in the permanent locking position, and wherein the second double locking part releases double locking to the second terminal, when the first connector housing and the second connector housing are held in the temporary locking position.

* * * * *